US012459031B2

(12) United States Patent
Choi et al.

(10) Patent No.: US 12,459,031 B2
(45) Date of Patent: Nov. 4, 2025

(54) APPARATUS FOR MANUFACTURING A PANEL FOR A VEHICLE

(71) Applicants: HYUNDAI MOTOR COMPANY, Seoul (KR); Kia Corporation, Seoul (KR)

(72) Inventors: Yongshin Choi, Anyang-si (KR); Daero Lee, Hwaseong-si (KR)

(73) Assignees: HYUNDAI MOTOR COMPANY, Seoul (KR); Kia Corporation, Seoul (KR)

( * ) Notice: Subject to any disclaimer, the term of this patent is extended or adjusted under 35 U.S.C. 154(b) by 264 days.

(21) Appl. No.: 18/143,731

(22) Filed: May 5, 2023

(65) Prior Publication Data

US 2024/0123489 A1 Apr. 18, 2024

(30) Foreign Application Priority Data

Oct. 18, 2022 (KR) ..... 10-2022-0134314

(51) Int. Cl.
*B21D 19/08* (2006.01)
*B21D 22/02* (2006.01)
*B21D 53/88* (2006.01)

(52) U.S. Cl.
CPC ..... *B21D 53/88* (2013.01); *B21D 22/02* (2013.01)

(58) Field of Classification Search
CPC ... B21D 19/086; B21D 19/084; B21D 19/082
USPC ..... 72/452.1–452.9
See application file for complete search history.

(56) References Cited

U.S. PATENT DOCUMENTS 7,258,030 B2 * 8/2007 McCallum ..... B21D 19/086 74/122

FOREIGN PATENT DOCUMENTS

FR 3008910 A1 * 1/2015 ..... B21D 19/084

* cited by examiner

*Primary Examiner* — Debra M Sullivan
(74) *Attorney, Agent, or Firm* — MORGAN, LEWIS & BOCKIUS LLP

(57) ABSTRACT

An apparatus for manufacturing a panel for a vehicle configured to process a processing plate pre-processed by at least one mold into the panel of a predetermined shape by at least one another mold may include a lower die including a lower base mounted with at least one lower forming steel, an upper die provided vertically movable at a position corresponding to the lower die, and including an upper base mounted with at least one upper forming steel, and at least one cam press unit provided on the lower die and the upper die, and configured to form a flange portion in an edge portion of the processing plate along a vertical direction, and to form a cam forming portion extending from the flange portion along an oblique direction.

15 Claims, 22 Drawing Sheets

APPARATUS FOR MANUFACTURING A PANEL FOR A VEHICLE

CROSS-REFERENCE TO RELATED APPLICATION

The present application claims priority to Korean Patent Application No. 10-2022-0134314 filed on Oct. 18, 2022, the entire contents of which is incorporated herein for all purposes by this reference.

BACKGROUND OF THE PRESENT DISCLOSURE

Field of the Present Disclosure

The present disclosure relates to an apparatus for manufacturing a panel for a vehicle. The present disclosure relates to an apparatus for manufacturing a panel for a vehicle configured to form a fender panel of a vehicle into a predetermined shape.

Description of Related Art

In general, it is necessary to go through several forming processes to produce one complete vehicle body panel.

A vehicle body panel may be formed into a predetermined shape through a drawing process, a trimming process, a piercing process, a flanging process, a cam forming process, and the like of a panel material (e.g., a blank).

For example, a fender panel for a vehicle is manufactured through four molds (e.g., a first mold, a second mold, a third mold, and a fourth mold) in the related art.

The first mold is used to perform the drawing process of molding the panel material into the predetermined shape. The second mold may be used to perform the trimming process for trimming the panel material, piercing process for hole-processing the panel material, and the like. The third mold may be used to perform the flanging process of folding an edge portion of the panel material. Furthermore, the fourth mold may be used to perform, e.g., the cam forming process for forming a forming portion of a predetermined shape in the flange portion formed by the flanging process, and the fender panel may thereby be finalized.

However, in the case of using a plurality of molds for forming the vehicle body panel as described above, the manufacturing cost for the molds increases, and the amount of land used in the factory using the molds also increases.

Furthermore, as the number of molds increases, a manufacturing period of the vehicle body panel also increases. Furthermore, when the number of molds increases, the time required for setting up the equipment in a mass production plate increases, which acts as an unfavorable factor for production management.

Accordingly, there is a demand for research and development of a method capable of reducing the total numbers of molds and processes required for manufacturing the body panel.

The information included in this Background of the present disclosure is only for enhancement of understanding of the general background of the present disclosure and may not be taken as an acknowledgement or any form of suggestion that this information forms the prior art already known to a person skilled in the art.

BRIEF SUMMARY

Various aspects of the present disclosure are directed to providing a manufacturing device of a loop panel for a vehicle configured for reducing the number of molds and the number of processes for forming a fender panel for a vehicle.

An apparatus for manufacturing a panel for a vehicle configured to process a processing plate pre-processed by at least one mold into the panel of a predetermined shape by at least one another mold may include a lower die including a lower base mounted with at least one lower forming steel, an upper die provided vertically movable at a position corresponding to the lower die, and including an upper base mounted with at least one upper forming steel, and at least one cam press unit provided on the lower die and the upper die, and configured to form a flange portion in an edge portion of the processing plate along a vertical direction, and to form a cam forming portion extending from the flange portion along an oblique direction thereof.

The at least one cam press unit may be configured to form the flange portion by a first motion in the vertical direction, and The at least one cam press unit may be configured to form the cam forming portion by a second motion in the oblique direction, the cam forming portion including an undercut surface extending from the flange portion to an internal side of the processing plate.

The at least one cam press unit may include a swing cam rotatably provided on the lower base along a front and rear direction through a rotation center shaft and including a lower cam forming steel, and a cam slide slidably provided on the upper base along the front and rear direction to be in cam-contact with the swing cam and mounted with an upper cam forming steel corresponding to the lower cam forming steel.

The at least one lower forming steel may include a swing guide surface formed in a first edge portion and extending inwardly from the first edge portion.

The lower cam forming steel may include a slip surface configured to contact with the swing guide surface.

The lower cam forming steel may include a slip surface configured to contact with the swing guide surface.

The at least one cam press unit may include an operation cylinder provided on the lower base and including an operation rod configured for operating forwards and backwards along the front and rear direction, and a cam support block provided movable on the lower base along the front and rear direction to support a lower portion of the swing cam, and coupled to the operation rod.

The swing cam may include a first cam block including at least one first cam guide portion which is disposed inclined along the front and rear direction and in cam-contact with the cam slide, and a second cam block including the lower cam forming steel and extending from the first cam block The second cam block may include a steel supporting portion connected to the lower cam forming steel and configured to support the upper cam forming steel.

The cam slide may include a sliding cam body mounted with the upper cam forming steel and including at least one second cam guide portion which is in cam-contact with the at least one first cam guide portion and disposed inclined along the front and rear direction.

The lower cam forming steel may include a flange forming support portion formed in an edge portion of the lower cam forming steel along the vertical direction, and configured to form the flange portion, and an undercut forming support portion extending inwardly from the flange forming support portion, and configured to form the cam forming portion.

The upper cam forming steel may include a flange forming portion butted against the flange forming support portion in the vertical direction and configured to form the flange portion, and an undercut forming portion extending from the flange forming portion, butted against the undercut forming support portion in the oblique direction, and configured to form the cam forming portion.

The lower die may include a cam guide block which is fixed to the lower base, where the cam guide block includes a first guide surface configured to guide the cam slide in the vertical direction, and a second guide surface extending from the first guide surface to guide the cam slide in the oblique direction.

The upper die may include at least one gas spring provided on the upper base along the vertical direction and configured to pressurize the swing cam.

At least one spring support block for supporting the at least one gas spring may be fixed to the swing cam.

The upper die may include at least one cam drive block fixed to the upper base.

The lower die may include a pair of drive guide blocks disposed on the lower base at a preset interval so that the at least one cam drive block is insertable along the vertical direction thereof.

At least one pressurizing support block may be provided on the lower base, and

At least one pressurizing block for pressurizing the at least one pressurizing support block may be provided on the swing cam.

The at least one upper forming steel and the at least one cam press unit may be configured to simultaneously perform forming of the processing plate, at a position corresponding to the at least one lower forming steel.

A fender panel may be manufactured by forming the processing plate into the predetermined shape through the at least one another mold.

According to an exemplary embodiment of the present disclosure, the numbers of molds and processes required for manufacturing the fender panel may be decreased, and accordingly, mold investment cost, mold material cost, processing cost, cost required for production management, and the like may be reduced.

Other effects which may be obtained or are predicted by an exemplary embodiment will be explicitly or implicitly described in a detailed description of the present disclosure. That is, various effects that are predicted according to an exemplary embodiment will be described in the following detailed description.

The methods and apparatuses of the present disclosure have other features and advantages which will be apparent from or are set forth in more detail in the accompanying drawings, which are incorporated herein, and the following Detailed Description, which together serve to explain certain principles of the present disclosure.

Figure 1:
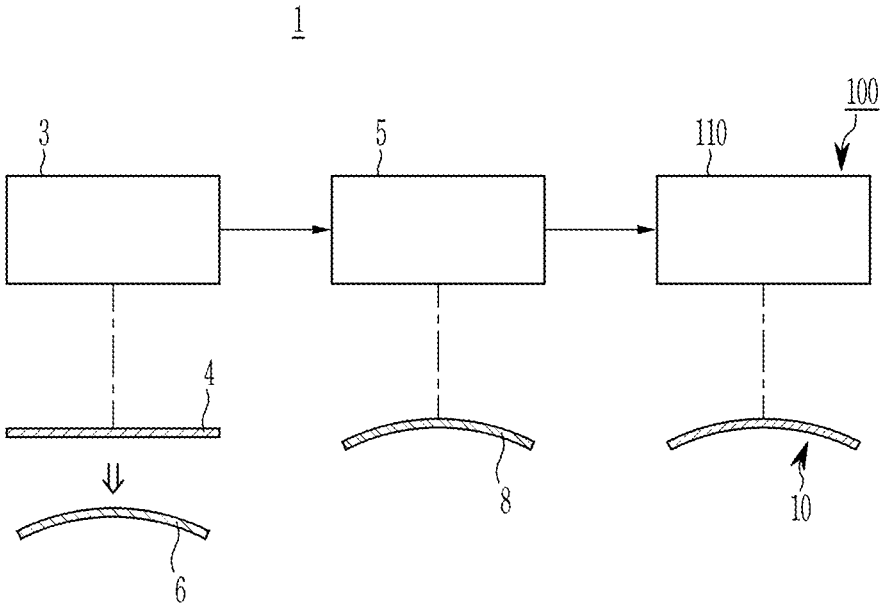
FIG. 1 is a block diagram schematically illustrating an apparatus for manufacturing a panel for a vehicle according to an exemplary embodiment of the present disclosure.

It may be understood that the appended drawings are not necessarily to scale, presenting a somewhat simplified representation of various features illustrative of the basic principles of the present disclosure. The specific design features of the present disclosure as included herein, including, for example, specific dimensions, orientations, locations, and shapes will be determined in part by the particularly intended application and use environment.

In the figures, reference numbers refer to the same or equivalent parts of the present disclosure throughout the several figures of the drawing.

DETAILED DESCRIPTION

Reference will now be made in detail to various embodiments of the present disclosure(s), examples of which are illustrated in the accompanying drawings and described below. While the present disclosure(s) will be described in conjunction with exemplary embodiments of the present disclosure, it will be understood that the present description is not intended to limit the present disclosure(s) to those exemplary embodiments of the present disclosure. On the other hand, the present disclosure(s) is/are intended to cover not only the exemplary embodiments of the present disclosure, but also various alternatives, modifications, equivalents and other embodiments, which may be included within the spirit and scope of the present disclosure as defined by the appended claims.

Exemplary embodiments of the present disclosure will be described more fully hereinafter with reference to the accompanying drawings, in which embodiments of the present disclosure are shown. As those skilled in the art would realize, the described embodiments may be modified in various different ways, all without departing from the spirit or scope of the present disclosure.

To clarify the present disclosure, parts that are not related to the description will be omitted, and the same elements or equivalents are referred to with the same reference numerals throughout the specification.

Also, the size and thickness of each element are arbitrarily shown in the drawings, but the present disclosure is not necessarily limited thereto, and in the drawings, the thickness of layers, films, panels, regions, etc., are exaggerated for clarity.

In addition, in the following description, dividing names of components into first, second, and the like is to divide the names because the names of the components are the same as each other and an order thereof is not particularly limited.

In addition, unless explicitly described to the contrary, the word "comprise" and variations such as "comprises" or "comprising", will be understood to imply the inclusion of stated elements but not the exclusion of any other elements.

Furthermore, each of terms, such as " . . . unit", " . . . means", " . . . part", and " . . . member" described in the specification, mean a unit of a comprehensive element that is configured to perform at least one function or operation.

The terminology used herein is for describing specific examples only and is not intended to be limiting of the present disclosure. As used herein, the singular forms are intended to include the plural forms as well, unless the context clearly indicates otherwise.

As used herein, the term "comprises" and/or "comprising" refers to the presence of specified features, integers, steps, acts, elements and/or components, but it should also be understood that it does not exclude a presence or an addition of one or more other features, integers, steps, acts, components, and/or groups thereof. As used herein, the term "and/or" includes any one or all combinations of one or more related items.

The term "coupled" or "connected" denotes a physical relationship between two components in which components are directly connected to each other or indirectly through one or more intermediary components.

It is understood that the term "vehicle," "vehicular," "car," or other similar term as used herein is inclusive of, in general, passenger automobiles including sports cars, sports utility vehicles (SUV), buses, trucks, various commercial vehicles, and inclusive of hybrid vehicles, electric vehicles, hybrid electric vehicles, hydrogen-powered vehicles, purpose built vehicles (PBV), and other alternative fuel vehicles (e.g., fuels derived from resources other than petroleum).

Hereinafter, an example of the present disclosure is described in detail with reference to the accompanying drawing.

FIG. 1 is a block diagram schematically illustrating an apparatus for manufacturing a panel for a vehicle according to an exemplary embodiment of the present disclosure.

Referring to FIG. 1, an apparatus 100 for manufacturing a panel for a vehicle according to various exemplary embodiments of the present disclosure may be applied to a press system 1 for manufacturing a vehicle body panel in a vehicle body sub-assembly line.

The press system 1 is configured to form the vehicle body panel into a predetermined shape through a drawing process, a trimming process, a piercing process, a restriking process, a flanging process, a cam forming process, and the like.

In an exemplary embodiment of the present disclosure, the press system 1 may form a fender panel 10 of a predetermined shape through the above-mentioned processes.

The press system 1 may include a first mold 3, a second mold 5, and the apparatus 100 for manufacturing a panel for a vehicle according to an exemplary embodiment of the present disclosure.

The first mold 3 may process a blank 4 as a panel material, e.g., by a drawing process, to form a first predetermined shape. The second mold 5 may process a first processing plate 6 processed by the first mold 3 by various processes (for example, a trimming process, a piercing process, a restriking process, and the like) to form a different shape of a second processing plate 8.

Furthermore, the apparatus 100 for manufacturing a panel for a vehicle according to an exemplary embodiment of the present disclosure includes a third mold 110 which may be used to process the second processing plate 8 pre-processed by the first mold 3 and the second mold 5 to form the fender panel 10 of the final shape.

Figure 2:
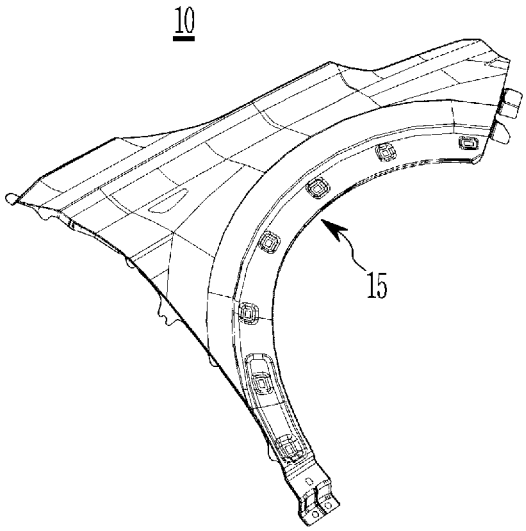
FIG. 2 and FIG. 3 show an example of a fender panel manufactured by an apparatus for manufacturing a panel for a vehicle according to an exemplary embodiment of the present disclosure.
Figure 3:
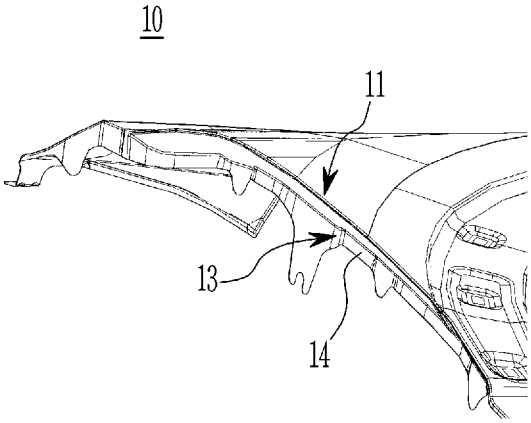

Here, in an exemplary embodiment of the present disclosure, as shown in FIG. 2 and FIG. 3, the fender panel 10 manufactured by the apparatus 100 for manufacturing a panel for a vehicle according to an exemplary embodiment of the present disclosure includes a flange portion 11, a cam forming portion 13, and a wheel arch portion 15.

The flange portion 11 and the cam forming portion 13 are provided as door opening of the fender panel 10, and may be formed on a first edge portion of the fender panel 10. Furthermore, the wheel arch portion 15 may be formed in a second edge portion of the fender panel 10.

Furthermore, the flange portion 11 may be formed in the first edge portion of the fender panel 10 along a vertical direction thereof. Furthermore, the cam forming portion 13 may be formed as an undercut region extending from the flange portion 11 to an internal side of the first edge portion of the fender panel 10. Here, the cam forming portion 13 includes an undercut surface 14 configured for securing an operating space of a door in consideration of a rotation radius of the door under operation.

In an exemplary embodiment of the present disclosure, a longitudinal direction of the fender panel 10 and the third mold 110 may be defined as a front and rear direction, and a width direction of the fender panel 10 and the third mold 110 may be defined as a left-and-right direction thereof.

Furthermore, in the present specification, "upper end portion", "upper portion", "upper end", or "upper portion surface" of a component indicates end, part, end portion, or surface of the component which is relatively positioned higher in the drawing, and "lower end portion", "lower portion", "lower end", or "lower portion surface" of a component indicates end portion, portion, end, or surface of the component which is relatively positioned lower in the drawing.

In addition, in the present specification, "end" (for example, one end, another end, or the like) of a component indicates an end portion of the component in any direction, and "end portion" (for example, one end portion, another end portion, or the like) of a component indicates a certain part of the component including the end.

The apparatus 100 for manufacturing a panel for a vehicle according to various exemplary embodiments of the present disclosure may be structured so that the number of molds and required processes of the press system 1 required to form the fender panel 10 may be substantially decreased.

That is, the apparatus 100 for manufacturing a panel for a vehicle according to various exemplary embodiments of the present disclosure may form the flange portion 11 and the cam forming portion 13 in a first edge portion of the second processing plate 8 (refer to FIG. 1) through the single third mold 110, and manufacture the fender panel 10 of the final shape.

Furthermore, the apparatus 100 for manufacturing a panel for a vehicle according to various exemplary embodiments of the present disclosure may form the wheel arch portion 15 in a second edge portion of the second processing plate 8, and may form at least one third edge portion of the second processing plate 8 into the final predetermined shape.

Figure 4:
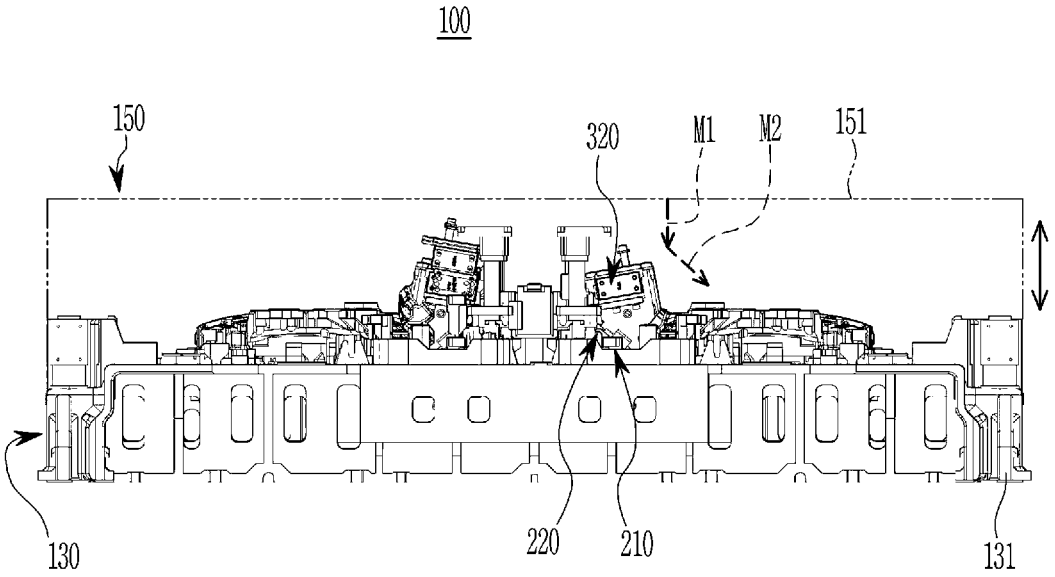
FIG. 4 is a side view showing an apparatus for manufacturing a panel for a vehicle according to an exemplary embodiment of the present disclosure.
Figure 5:
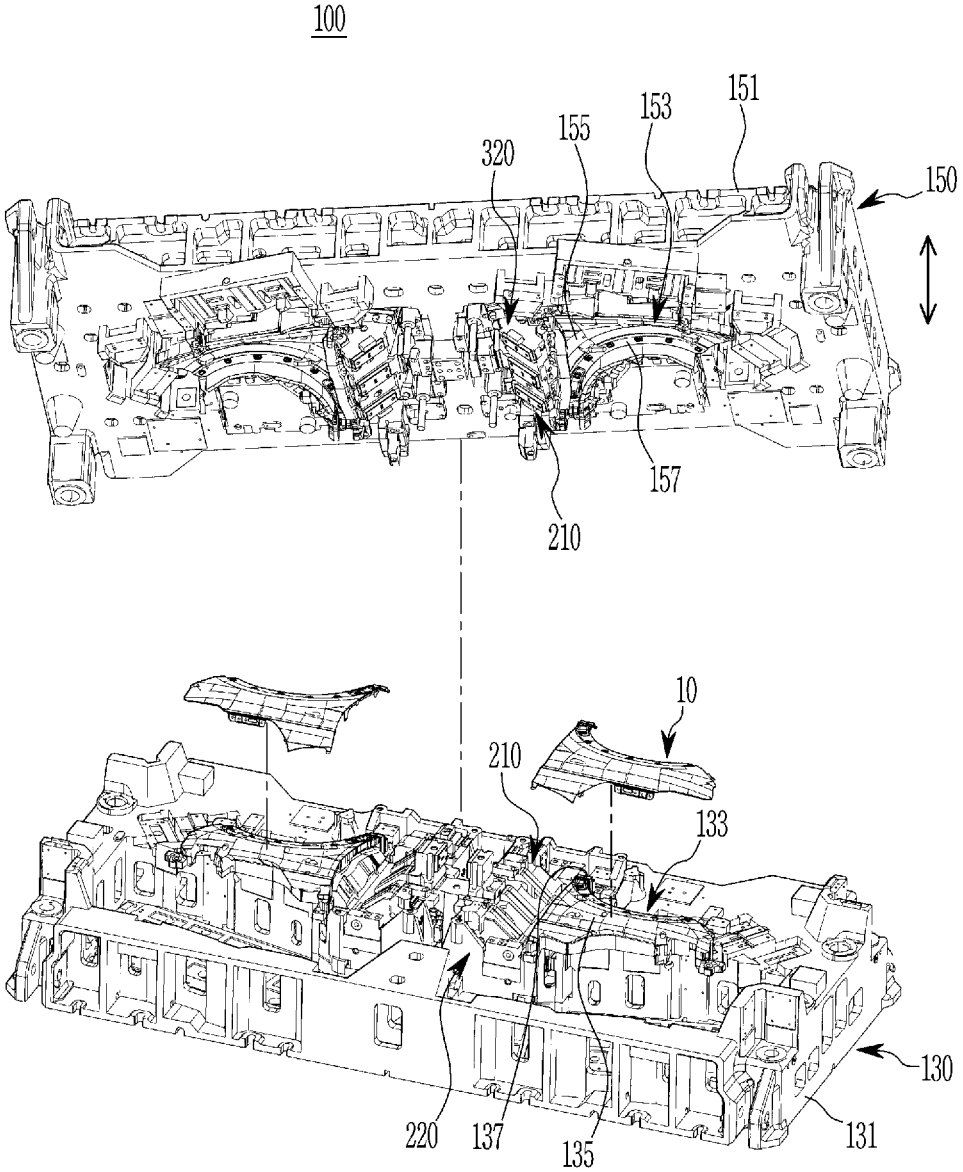
FIG. 5 is an exploded perspective view showing an apparatus for manufacturing a panel for a vehicle according to an exemplary embodiment of the present disclosure.

FIG. 4 is a side view showing an apparatus for manufacturing a panel for a vehicle according to an exemplary embodiment of the present disclosure. FIG. 5 is an exploded perspective view showing an apparatus for manufacturing a panel for a vehicle according to an exemplary embodiment of the present disclosure.

Referring to FIG. 4 and FIG. 5, the apparatus 100 for manufacturing a panel for a vehicle according to an exemplary embodiment of the present disclosure includes a lower die 130, an upper die 150, and at least one cam press unit 210.

In an exemplary embodiment of the present disclosure, the lower die 130 includes a lower base 131 fixed to a bottom portion of a process work area. Furthermore, the lower die 130 include at least one lower forming steel 133 mounted on the lower base 131.

The at least one lower forming steel 133 is configured to support a lower surface of the second processing plate 8, and to form a lower surface of the fender panel 10. In an exemplary embodiment of the present disclosure, as shown in the drawings, the at least one lower forming steel 133 may be provided in a pair on the lower base 131.

The at least one lower forming steel 133 includes a lower steel body 135 and a wheel arch forming support portion 137. The lower steel body 135 is fixed to the lower base 131.

A first edge portion of the lower steel body 135 is configured to support portion connected to the first edge portion of the second processing plate 8. The wheel arch forming support portion 137 is formed in a second edge portion of the lower steel body 135. The wheel arch forming support portion 137 is configured to form the wheel arch portion 15 (refer to FIG. 2 and FIG. 3) in the second edge portion of the second processing plate 8.

Referring to FIG. 4 and FIG. 5, in an exemplary embodiment of the present disclosure, the upper die 150 provided to be vertically movable at a position corresponding to the lower die 130. The upper die 150 may reciprocally move in the vertical direction by a hydraulic pressure cylinder device known to a person skilled in the art.

The upper die 150 includes at least one upper forming steel 153 mounted on an upper base 151.

The at least one upper forming steel 153 is configured to support an upper surface of the second processing plate 8, and to form an upper surface of the fender panel 10. Furthermore, the at least one upper forming steel 153 is configured to form the wheel arch portion 15 in the second edge portion of the second processing plate 8.

In an exemplary embodiment of the present disclosure, as shown in the drawings, the at least one upper forming steel 153 may be provided in a pair on the upper base 151.

The at least one upper forming steel 153 includes an upper steel body 155 and a wheel arch forming portion 157.

The upper steel body 155 is fixed to the upper base 151. The wheel arch forming portion 157 is formed in the upper steel body 155 to form the wheel arch portion 15.

Referring to FIG. 4 and FIG. 5, in an exemplary embodiment of the present disclosure, the at least one cam press unit 210 is configured to form the flange portion 11 (refer to FIG. 2 and FIG. 3) in the first edge portion of the second processing plate 8 along the vertical direction, and to form the cam forming portion 13 (refer to FIG. 2 and FIG. 3) extending from the flange portion 11 along the oblique direction thereof.

The at least one cam press unit 210 is provided on the lower die 130 and the upper die 150. In an exemplary embodiment of the present disclosure, as shown in the drawings, the at least one cam press unit 210 may be provided in a pair on the lower die 130 and the upper die 150.

The at least one cam press unit 210 may form the flange portion 11 by a first motion M1 in the vertical direction thereof. Furthermore, the at least one cam press unit 210 may form the cam forming portion 13 extending from the flange portion 11 to an internal side of the second processing plate 8 by a second motion M2 in the oblique direction thereof.

Figure 6:
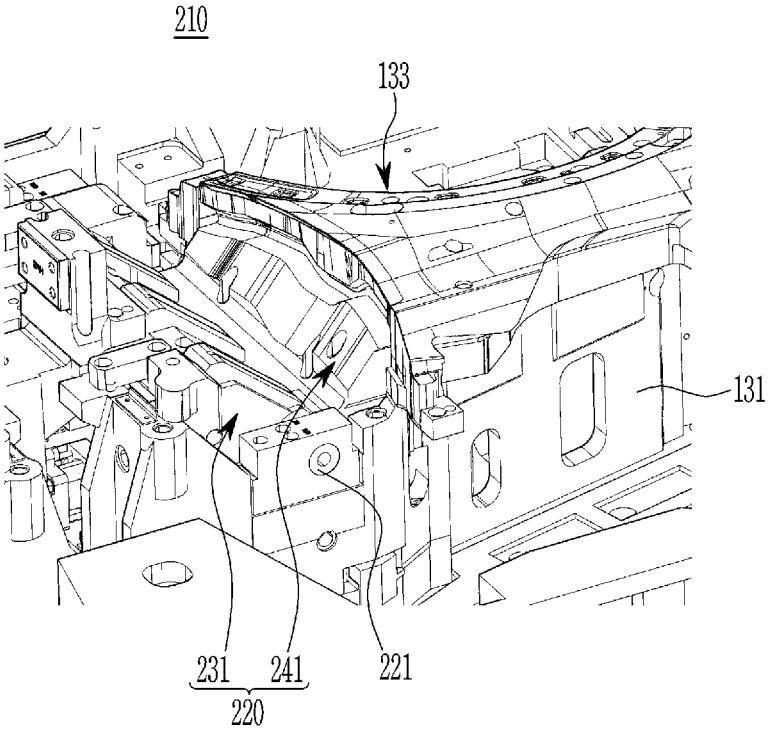
FIG. 6 is a partial perspective view of a lower die showing a swing cam of a cam press unit applied to an apparatus for manufacturing a panel for a vehicle according to an exemplary embodiment of the present disclosure.
Figure 7:
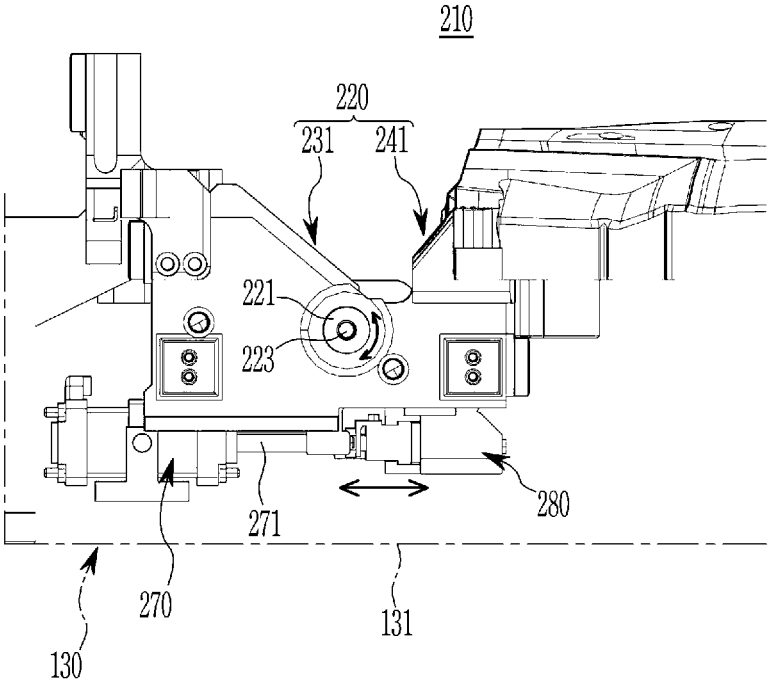
FIG. 7 is a side view showing a swing cam of a cam press unit applied to an apparatus for manufacturing a panel for a vehicle according to an exemplary embodiment of the present disclosure.

FIG. 6 is a partial perspective view of a lower die showing a swing cam of a cam press unit applied to an apparatus for manufacturing a panel for a vehicle according to an exemplary embodiment of the present disclosure. FIG. 7 is a side view showing a swing cam of a cam press unit applied to an apparatus for manufacturing a panel for a vehicle according to an exemplary embodiment of the present disclosure.

Referring to FIG. 4, FIG. 5, FIG. 6 and FIG. 7, the at least one cam press unit 210 according to an exemplary embodiment of the present disclosure includes a swing cam 220, an operation cylinder 270, a cam support block 280, and a cam slide 320.

The swing cam 220 is swing-rotatably provided on the lower base 131 along the front and rear direction through a rotation center shaft 221, at a position corresponding to a first edge portion of the at least one lower forming steel 133 of the lower die 130.

Here, the swing cam 220 is configured to be swing-rotatable for easy extraction (e.g., ejection) of the undercut region of the fender panel 10 finally formed by the at least one cam press unit 210.

The rotation center shaft 221 is coupled to an eccentric point 223 (e.g., a rotation center portion point) biased from a center portion of the swing cam 220. That is, the swing cam 220 may be swing-rotated along the front and rear direction through the rotation center shaft 221 coupled to the eccentric point 223.

The swing cam 220 includes a first cam block 231 and a second cam block 241 that are connected to each other.

Figure 8:
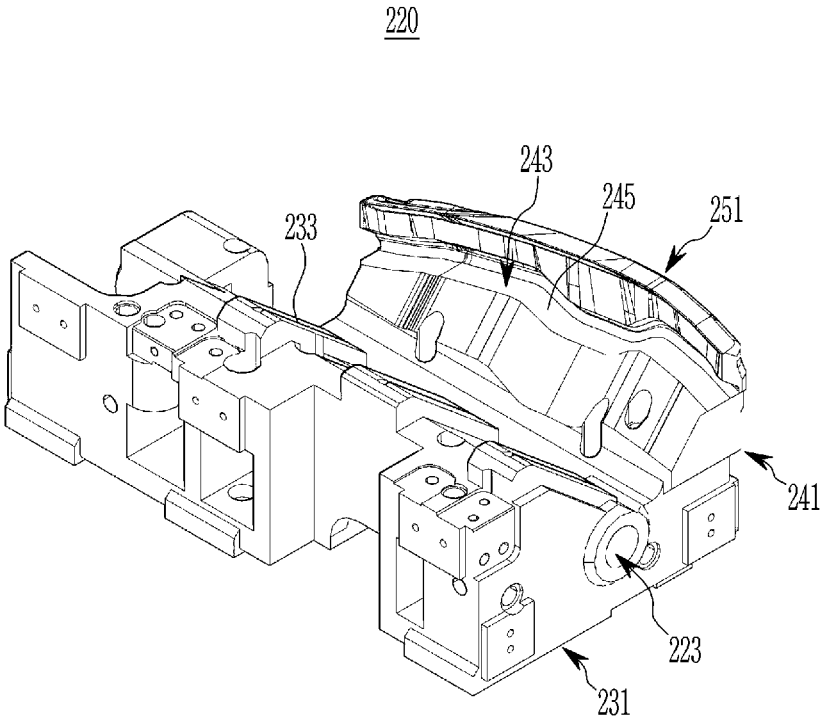
FIG. 8 and FIG. 9 are perspective views showing a swing cam of a cam press unit applied to an apparatus for manufacturing a panel for a vehicle according to an exemplary embodiment of the present disclosure.
Figure 9:
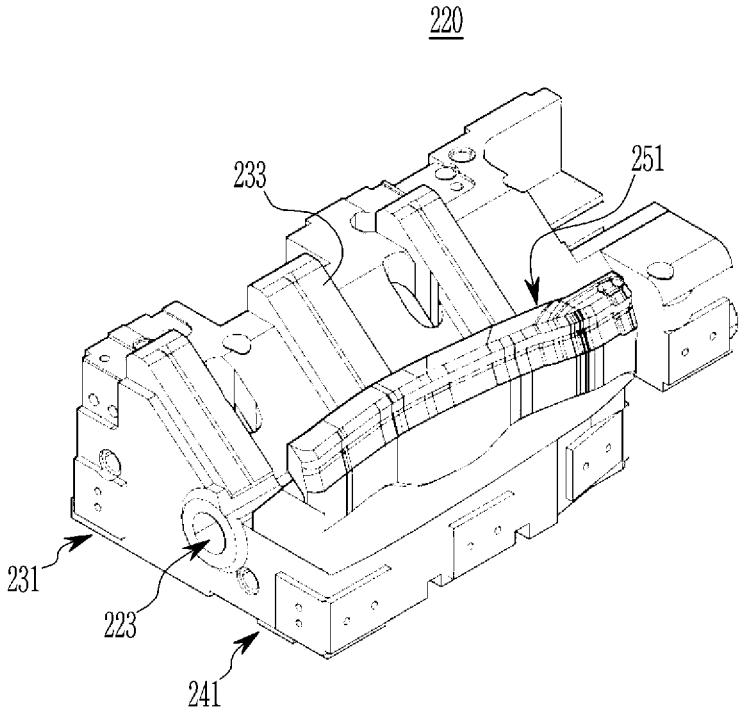

FIG. 8 and FIG. 9 are perspective views showing a swing cam of a cam press unit applied to an apparatus for manufacturing a panel for a vehicle according to an exemplary embodiment of the present disclosure.

Referring to FIG. 6 to FIG. 9, the first cam block 231 includes at least one first cam guide portion 233 inclined from an upper side of the front (or rear) to a lower side of the rear (or front). The at least one first cam guide portion 233 is configured to be in cam-contact with the cam slide 320 (refer to FIG. 4 and FIG. 5) which is further described later.

Here, the first cam block 231 forms the eccentric point 223 described above.

The second cam block 241 extends from the first cam block 231, and is disposed at a position corresponding to the at least one lower forming steel 133. The second cam block 241 includes a steel supporting portion 243 and a lower cam forming steel 251.

The steel supporting portion 243 is inclined from a lower side of the front (or rear) to an upper side of the rear (or front). A steel support surface 245 is formed in an upper portion of the steel supporting portion 243.

The lower cam forming steel 251 is configured to form the flange portion 11 (refer to FIG. 2 and FIG. 3) and the cam forming portion 13 (refer to FIG. 2 and FIG. 3) in the first edge portion of the second processing plate 8.

The lower cam forming steel 251 is integrally formed on the steel supporting portion 243 at a position corresponding to the at least one lower forming steel 133. Here, the lower cam forming steel 251 is disposed on an upper side of the steel support surface 245 with a preset interval to the steel support surface 245 of the steel supporting portion 243.

Figure 10:
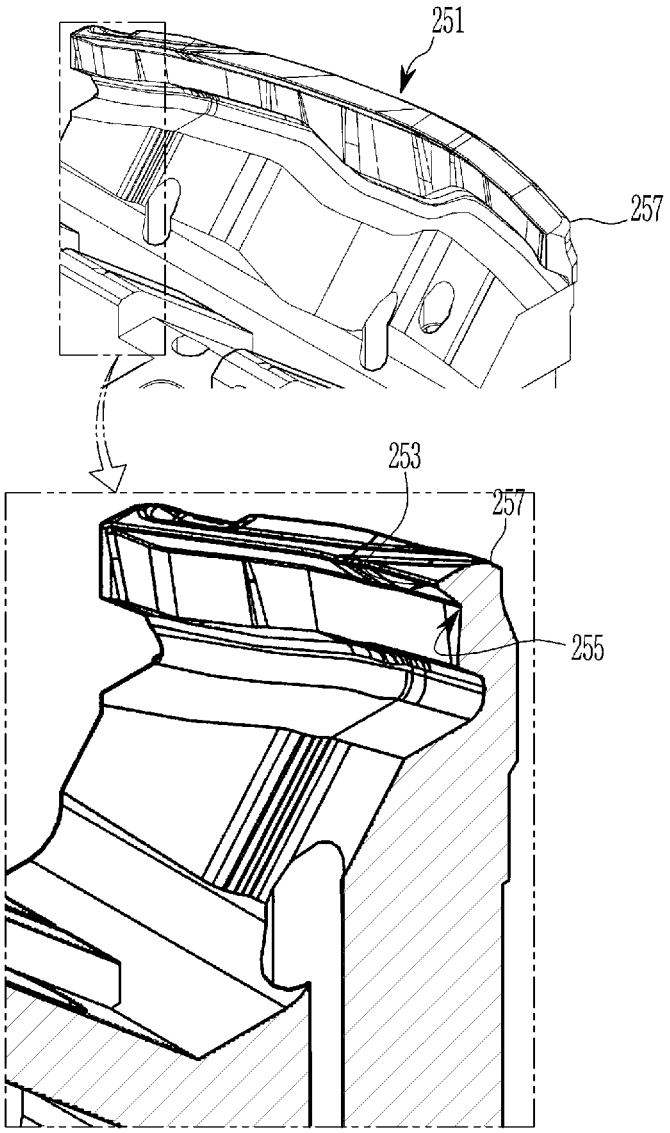
FIG. 10 is a drawing showing a lower cam forming steel of a cam press unit applied to an apparatus for manufacturing a panel for a vehicle according to an exemplary embodiment of the present disclosure.

Here, the lower cam forming steel 251 includes as shown in FIG. 10, a flange forming support portion 253 and an undercut forming support portion 255.

The flange forming support portion 253 is formed in an edge portion of the lower cam forming steel 251 along the vertical direction to form the flange portion 11 in the first edge portion of the second processing plate 8.

Furthermore, the undercut forming support portion 255 is configured to form the cam forming portion 13 extending from the flange portion 11 to the internal side of the second processing plate 8. The undercut forming support portion 255 extends from the flange forming support portion 253 to an internal side of the lower cam forming steel 251.

Furthermore, the lower cam forming steel 251 includes a slip surface 257 that enables the swing cam 220 to swing-rotate, at a position corresponding to the at least one lower forming steel 133.

In the lower cam forming steel 251, the slip surface 257 may be formed on a surface opposite to a surface where the flange forming support portion 253 and the undercut forming support portion 255 is formed.

Figure 11:
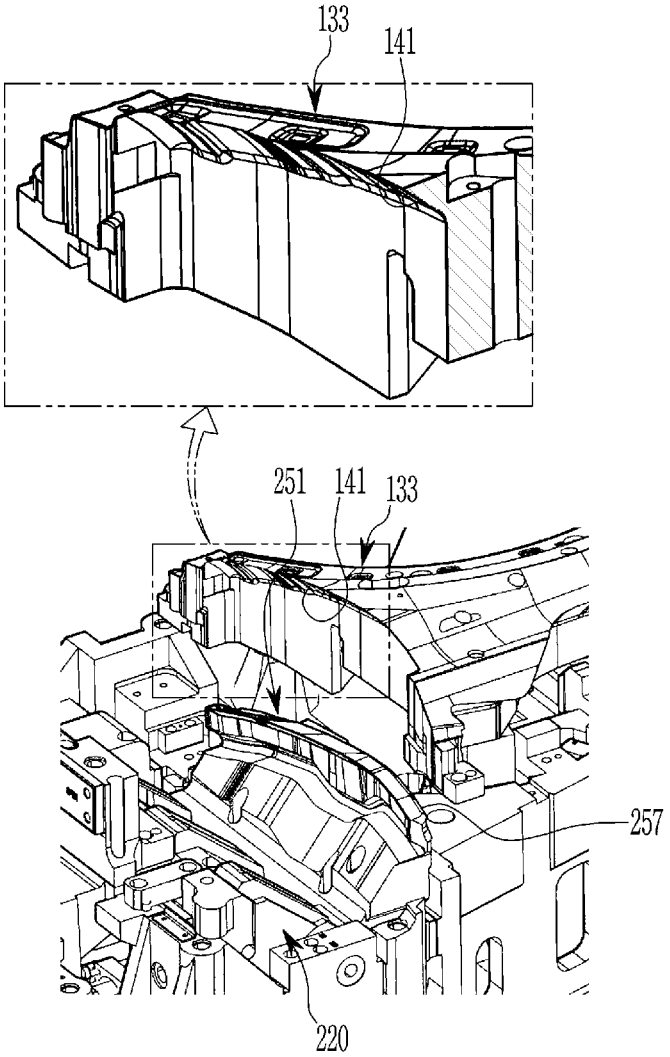
FIG. 11 is a drawing showing a lower forming steel of a lower die applied to an apparatus for manufacturing a panel for a vehicle according to an exemplary embodiment of the present disclosure.

Here, as shown in FIG. 11, the at least one lower forming steel 133 includes a swing guide surface 141 slip-contacting with the slip surface 257 of the lower cam forming steel 251. The swing guide surface 141 is configured to guide the slip surface 257 when the swing cam 220 swing-rotates. The swing guide surface 141 is formed to extend inwardly from the first edge portion of the at least one lower forming steel 133.

Referring to FIG. 7, the operation cylinder 270 is provided on the lower base 131 to be configured for operating forwards and backwards thereof, at a position corresponding to the swing cam 220.

The operation cylinder 270 is disposed on the lower base 131 along the front and rear direction with the swing cam 220 thereabove, and is fixed to the lower base 131. In an exemplary embodiment of the present disclosure, the operation cylinder 270 includes an operation rod 271 that moves forwards and backwards along the front and rear direction by a hydraulic pressure.

The cam support block 280 is configured to support a lower portion of the swing cam 220. The cam support block 280 is provided movable on the lower base 131 along the front and rear direction at a lower side of the swing cam 220. The cam support block 280 is coupled to the operation rod 271 of the operation cylinder 270.

Here, when the operation rod 271 moves backward by operation of the operation cylinder 270, the cam support block 280 moves backward, and the swing cam 220 may be rotated toward the front (or rear) through the rotation center shaft 221.

Furthermore, when the operation rod 271 moves forward by operation of the operation cylinder 270, the cam support block 280 moves forward, and the swing cam 220 may be rotated toward the rear (or front) through the rotation center shaft 221. Rotation position of the swing cam 220 according to the forward movement of the operation rod 271 may be set as a reference position of the swing cam 220 for forming the flange portion 11 and the cam forming portion 13.

Referring to FIG. 4 and FIG. 5, the cam slide 320 is configured to form the flange portion 11 and the cam forming portion 13 in the first edge portion of the second processing plate 8 through the swing cam 220.

The cam slide 320 is slidably provided on the upper base 151 of the upper die 150 along the front and rear direction to be in cam-contact with the swing cam 220.

Figure 12:
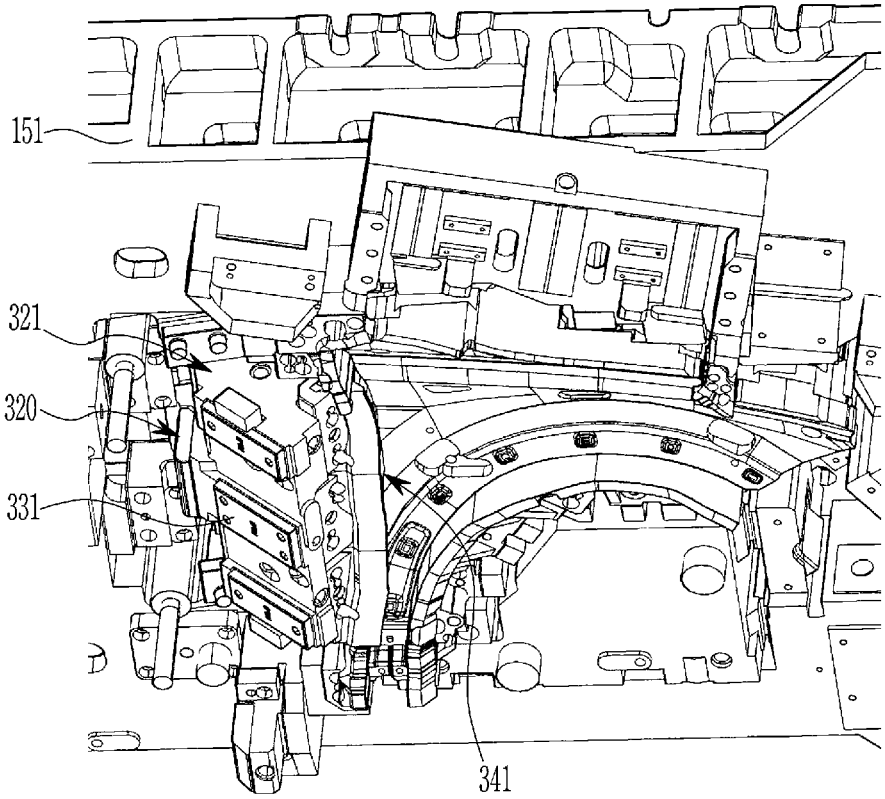
FIG. 12 is a partial perspective view of an upper die showing a cam slide of a cam press unit applied to an apparatus for manufacturing a panel for a vehicle according to an exemplary embodiment of the present disclosure.

FIG. 12 is a partial perspective view of an upper die showing a cam slide of a cam press unit applied to an apparatus for manufacturing a panel for a vehicle according to an exemplary embodiment of the present disclosure.

Referring to FIG. 12, the cam slide 320 includes a sliding cam body 321 which is mounted with at least one second cam guide portion 331 and an upper cam forming steel 341.

The sliding cam body 321 is provided in a block shape. A first surface of the sliding cam body 321 may be slidably coupled to the upper base 151 along the front and rear direction thereof.

The at least one second cam guide portion 331 is configured to be in cam-contact with the at least one first cam guide portion 233 of the swing cam 220 as shown in FIG. 8 and FIG. 9. The at least one second cam guide portion 331 is disposed on a second surface of the sliding cam body 321 to be inclined along the front and rear direction thereof.

Here, the sliding cam body 321 may be in cam-contact with the at least one first cam guide portion 233 through the at least one second cam guide portion 331, and may move along the oblique direction while sliding along the at least one first cam guide portion 233.

That is, the at least one first cam guide portion 233 of the swing cam 220 provide a function of converting the moving direction of the sliding cam body 321 according to an up and down movement of the upper die 150 from the vertical direction to the oblique direction thereof.

The upper cam forming steel 341 is configured to form the flange portion 11 and the cam forming portion 13 in the first edge portion of the second processing plate 8 through the lower cam forming steel 251, at a position corresponding to the lower cam forming steel 251 of the swing cam 220 as shown in FIG. 8 and FIG. 9.

The upper cam forming steel 341 is mounted on the second surface of the sliding cam body 321. The upper cam forming steel 341 may move along the oblique direction through the sliding cam body 321 while being supported by the steel supporting portion 243 of the swing cam 220. That is, the upper cam forming steel 341 may move in a direction becoming closer to or away from the lower cam forming steel 251.

Figure 13:
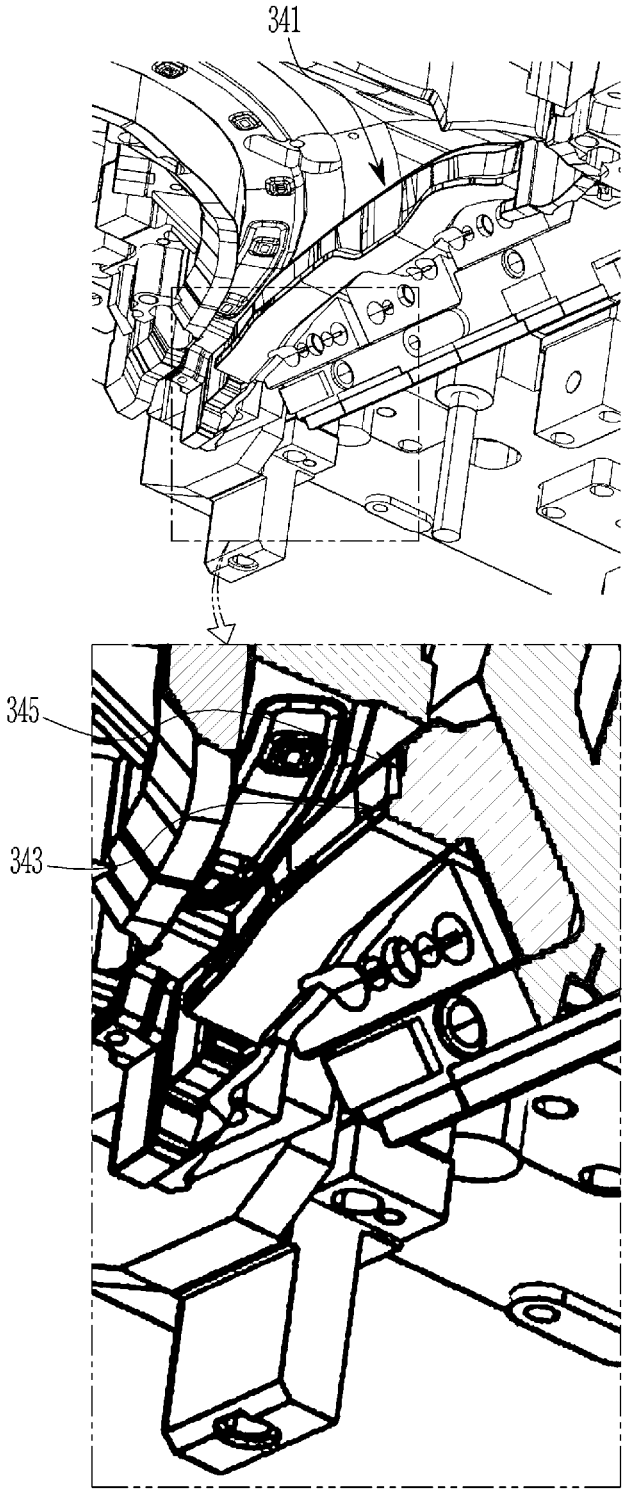
FIG. 13 is a drawing showing an upper cam forming steel of a cam press unit applied to an apparatus for manufacturing a panel for a vehicle according to an exemplary embodiment of the present disclosure.

As shown in FIG. 13, the upper cam forming steel 341 includes a flange forming portion 343 and an undercut forming portion 345.

The flange forming portion 343 is configured to form the flange portion 11 in the first edge portion of the second processing plate 8 through the flange forming support portion 253 of the lower cam forming steel 251 as shown in FIG. 10. The flange forming portion 343 is formed in an edge portion of the upper cam forming steel 341 along the vertical direction thereof.

The flange forming portion 343 is butted against the flange forming support portion 253 of the lower cam forming steel 251 along the vertical direction, and may form the flange portion 11.

Furthermore, the undercut forming portion 345 is configured to form the cam forming portion 13 extending from the flange portion 11 to the internal side of the second processing plate 8 through the undercut forming support portion 255 of the lower cam forming steel 251 as shown in FIG. 10. The undercut forming portion 345 is extended from the flange forming portion 343, butted against the undercut forming support portion 255 of the lower cam forming steel 251 along the oblique direction, and may form the cam forming portion 13.

Figure 14:
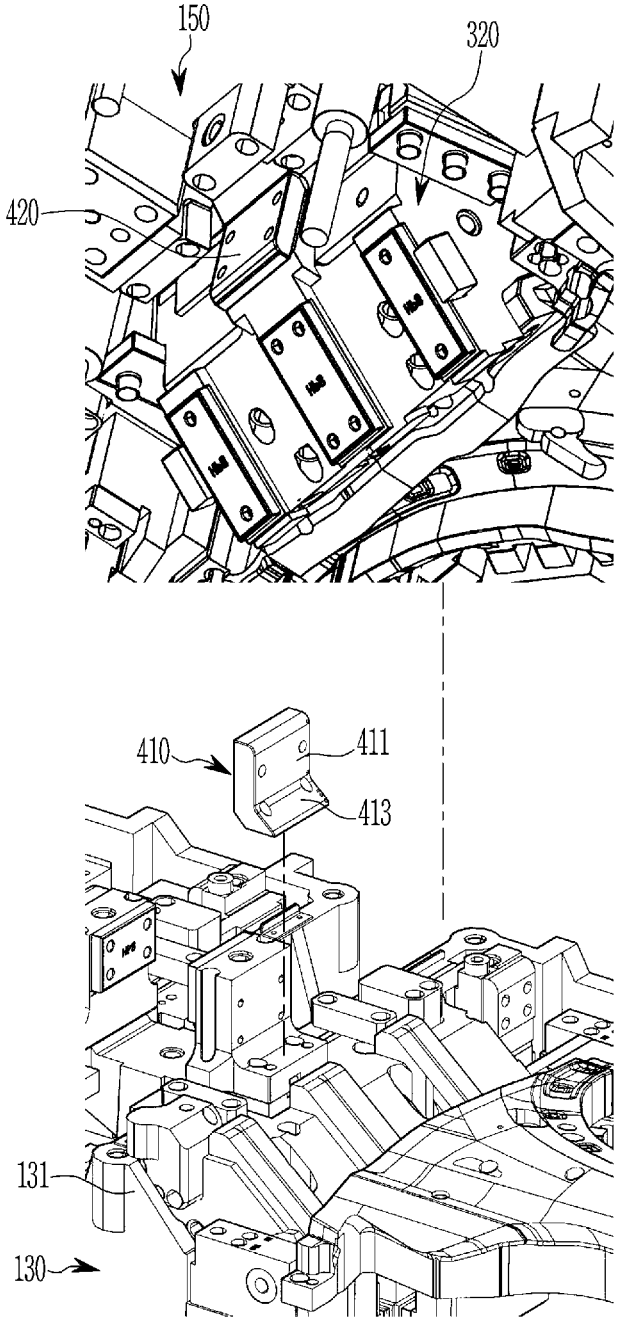
FIG. 14 is a drawing showing regions around a cam stroke plate of an upper die and a cam guide block of a lower die applied to an apparatus for manufacturing a panel for a vehicle according to an exemplary embodiment of the present disclosure.

FIG. 14 is a drawing showing regions around a cam stroke plate of an upper die and a cam guide block of a lower die applied to an apparatus for manufacturing a panel for a vehicle according to an exemplary embodiment of the present disclosure.

Referring to FIG. 14, in an exemplary embodiment of the present disclosure, the lower die 130 further includes a cam guide block 410 fixed to the lower base 131.

The cam guide block 410 is configured to guide the movement of the cam slide 320 along the vertical direction and the oblique direction when the upper die 150 descends. Here, the cam slide 320 includes a cam stroke plate 420 in contact with the cam guide block 410.

The cam guide block 410 is disposed on the lower base 131 along the vertical direction thereof. The cam guide block 410 includes a first guide surface 411 and a second guide surface 413.

The first guide surface 411 is formed along the vertical direction, and configured to guide the cam stroke plate 420 of the cam slide 320 along the vertical direction thereof. The second guide surface 413 extends from the first guide surface 411 along the oblique direction and is configured to guide the cam stroke plate 420 of the cam slide 320 in the oblique direction thereof.

Figure 15:
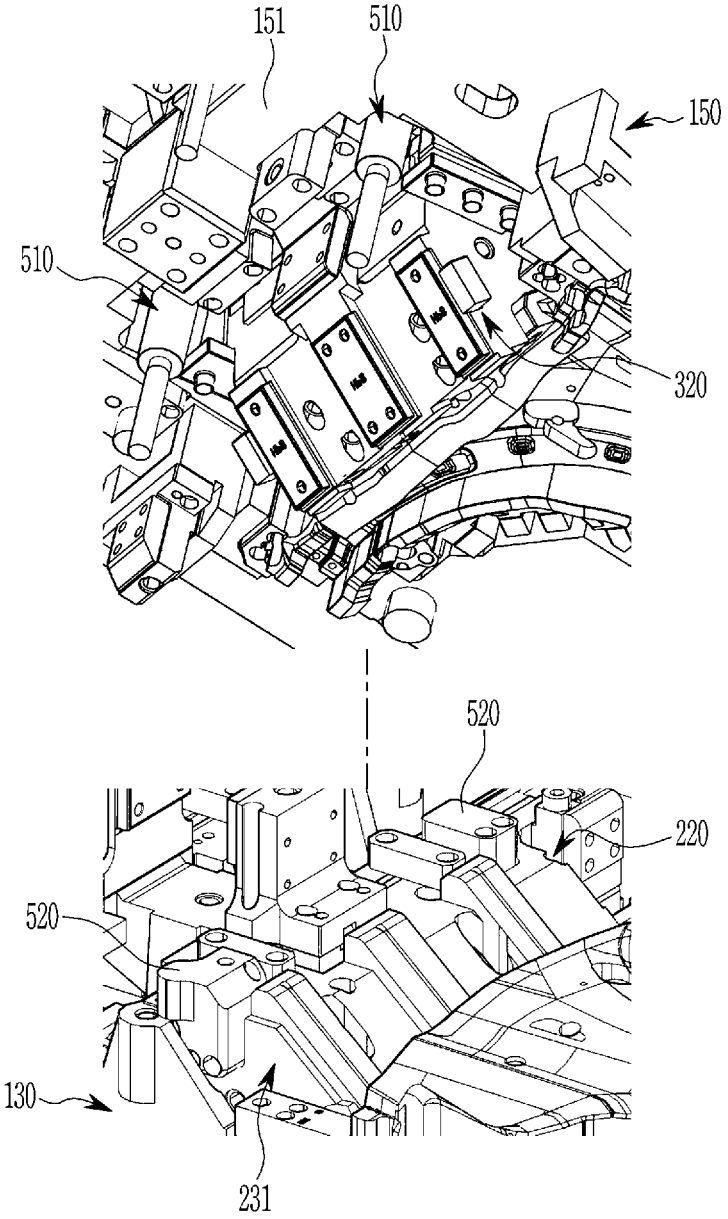
FIG. 15 is a drawing showing regions around a gas spring of an upper die and a spring support block of a lower die applied to an apparatus for manufacturing a panel for a vehicle according to an exemplary embodiment of the present disclosure.

FIG. 15 is a drawing showing regions around a gas spring of an upper die and a spring support block of a lower die applied to an apparatus for manufacturing a panel for a vehicle according to an exemplary embodiment of the present disclosure.

Referring to FIG. 15, in an exemplary embodiment of the present disclosure, the upper die 150 further includes at least one gas spring 510 provided on the upper base 151.

The at least one gas spring 510 is configured to pressurize the swing cam 220 of the lower die 130 when the upper die 150 descends. That is, before the cam-contacting of the swing cam 220 and the cam slide 320, the at least one gas spring 510 applies a preset pressurizing force to the swing cam 220, and is configured to prevent a returning rotation or movement of the swing cam 220.

The at least one gas spring 510 is fixed to the upper base 151 along the vertical direction, at a position corresponding to the swing cam 220.

Furthermore, in an exemplary embodiment of the present disclosure, at least one spring support block 520 is provided in the swing cam 220. The at least one spring support block 520 is configured to support the at least one gas spring 510.

The at least one spring support block 520 is fixed to the first cam block 231 of the swing cam 220, at a position corresponding to the at least one gas spring 510.

Figure 16:
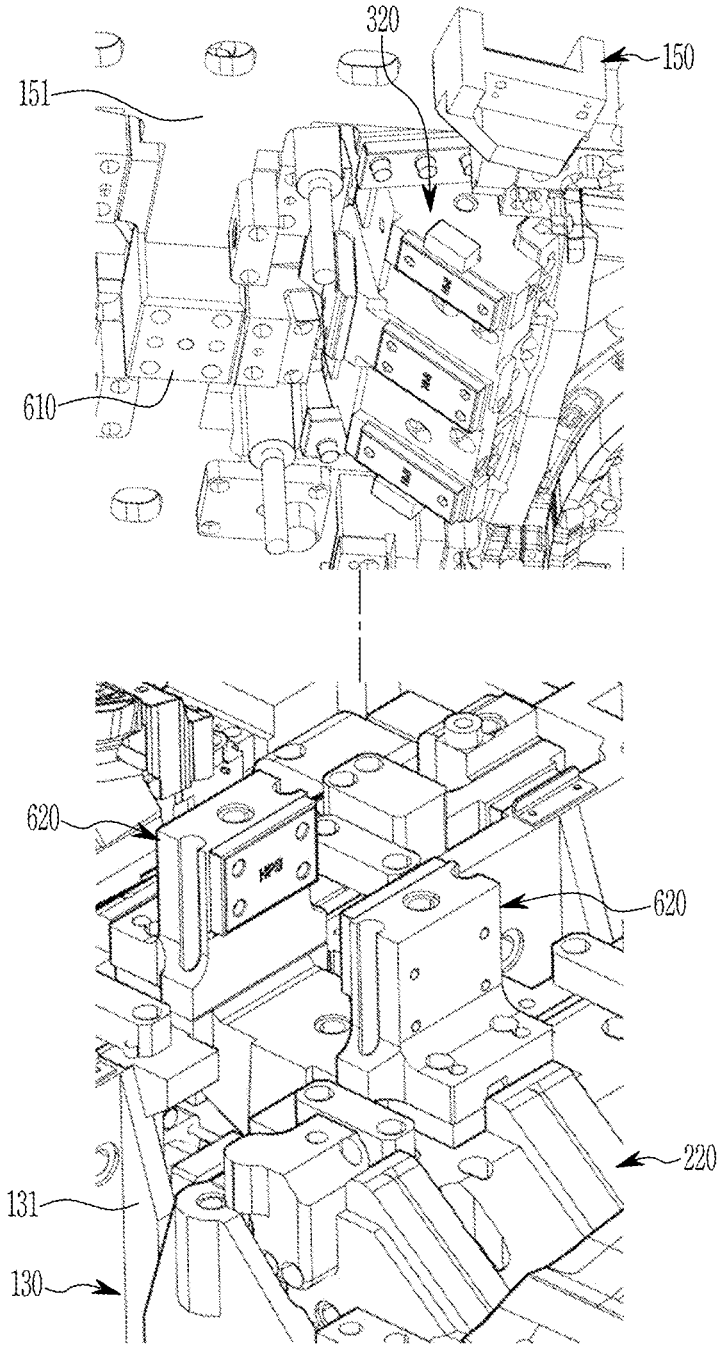
FIG. 16 is a drawing showing regions around a cam drive block of an upper die and a drive guide block of a lower die applied to an apparatus for manufacturing a panel for a vehicle according to an exemplary embodiment of the present disclosure.

FIG. 16 is a drawing showing regions around a cam drive block of an upper die and a drive guide block of a lower die applied to an apparatus for manufacturing a panel for a vehicle according to an exemplary embodiment of the present disclosure.

Referring to FIG. 16, in an exemplary embodiment of the present disclosure, the upper die 150 further includes at least one cam drive block 610 fixed to the upper base 151.

Furthermore, in an exemplary embodiment of the present disclosure, the lower die 130 further includes a pair of drive guide blocks 620 fixed to the lower base 131.

In an exemplary embodiment of the present disclosure, the at least one cam drive block 610 may be provided in a rectangular block shape.

The pair of drive guide blocks 620 is disposed on the lower base 131 at a preset interval so that the at least one cam drive block 610 is inserted along the vertical direction when the upper die 150 descends.

The at least one cam drive block 610 and the pair of drive guide blocks 620 may be coupled to each other along the vertical direction when the lower die 130 and the upper die 150 are combined with each other. In the instant case, the at least one cam drive block 610 and the pair of drive guide blocks 620 is configured to prevent slipping of the upper die 150 in the front and rear direction thereof.

Furthermore, the at least one cam drive block 610 and the pair of drive guide blocks 620 is configured to guide the cam slide 320 in downward direction by a predetermined guiding amount before forming of the flange portion 11 by the swing cam 220 and the cam slide 320 (e.g., before the cam-contacting).

Figure 17:
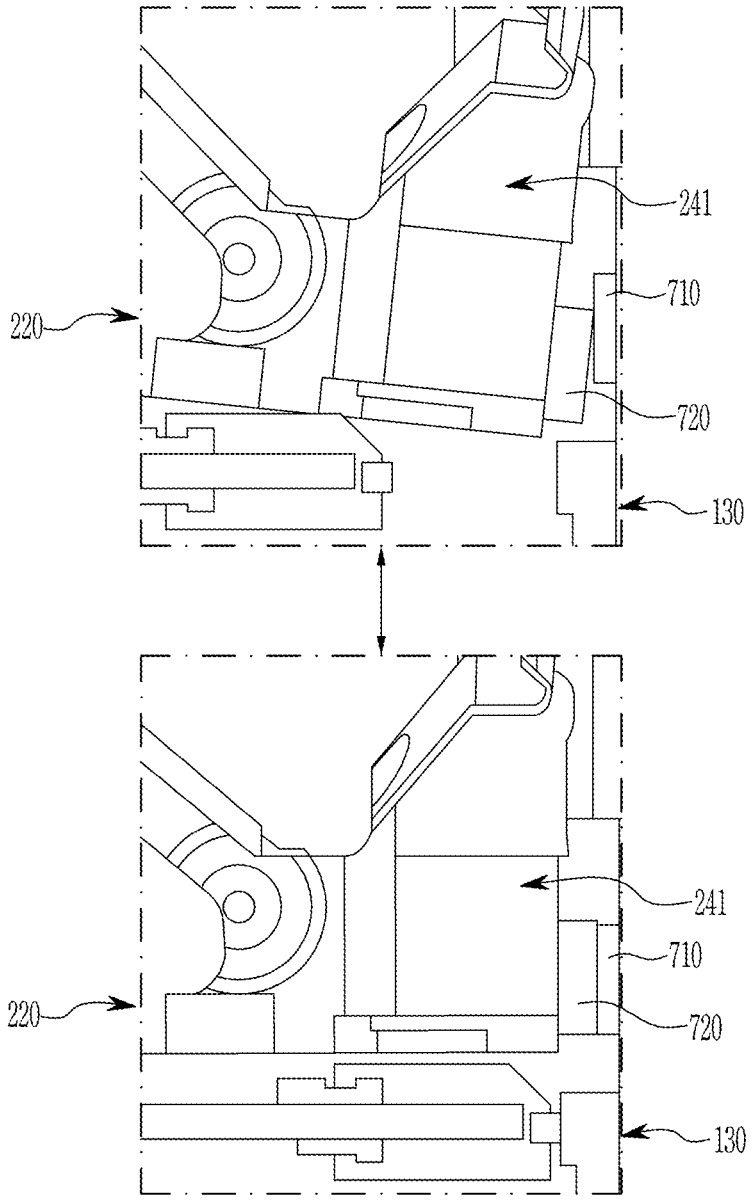
FIG. 17 is a drawing showing a region around a pressurizing support block of a lower die and a pressurizing block of a swing cam applied to an apparatus for manufacturing a panel for a vehicle according to an exemplary embodiment of the present disclosure.

FIG. 17 is a drawing showing a region around a pressurizing support block of a lower die and a pressurizing block of a swing cam applied to an apparatus for manufacturing a panel for a vehicle according to an exemplary embodiment of the present disclosure.

Referring to FIG. 17, in an exemplary embodiment of the present disclosure, the lower die 130 further includes at least one pressurizing support block 710 provided on the lower base 131.

The at least one pressurizing support block 710 is fixed to the lower base 131, at a position corresponding to the second cam block 241 of the swing cam 220.

Furthermore, in an exemplary embodiment of the present disclosure, at least one pressurizing block 720 is provided in the swing cam 220.

The at least one pressurizing block 720 is fixed to the second cam block 241 of the swing cam 220, at a position corresponding to the at least one pressurizing support block 710.

Here, the at least one pressurizing block 720 is configured to pressurize the at least one pressurizing support block 710, at a reference position of the swing cam 220 mentioned above.

That is, during the forming of the flange portion 11 by the swing cam 220, the at least one pressurizing block 720 is configured to apply a preset pressurizing force (e.g., a friction pressurizing force) to the at least one pressurizing support block 710, and to prevent returning rotation or movement of the swing cam 220.

Hereinafter, an operation of an apparatus for manufacturing a panel for a vehicle according to an exemplary embodiment configured as described above is described in detail with reference to the drawings.

FIG. 18 to FIG. 22 are drawings illustrating an operation of an apparatus for manufacturing a panel for a vehicle according to an exemplary embodiment of the present disclosure.

Referring to FIG. 1, first of all, in an exemplary embodiment of the present disclosure, the first mold 3 forms the blank 4 of the panel material into the first predetermined shape by a drawing process, and the first processing plate 6 processed by the first mold 3 is provided to the second mold 5.

Accordingly, the second mold 5 forms the first processing plate 6 into a second predetermined shape by various processes (for example, a trimming process, a piercing process, a restriking process, and the like). The second processing plate 8 processed by the second mold 5 is provided to the third mold 110 of the apparatus 100 for manufacturing a panel for a vehicle according to an exemplary embodiment of the present disclosure.

In the third mold 110 of the apparatus 100 for manufacturing a panel for a vehicle according to an exemplary embodiment of the present disclosure, the upper die 150 is in a state of being moved upward (e.g., released) at the position corresponding to the lower die 130.

Figure 18:
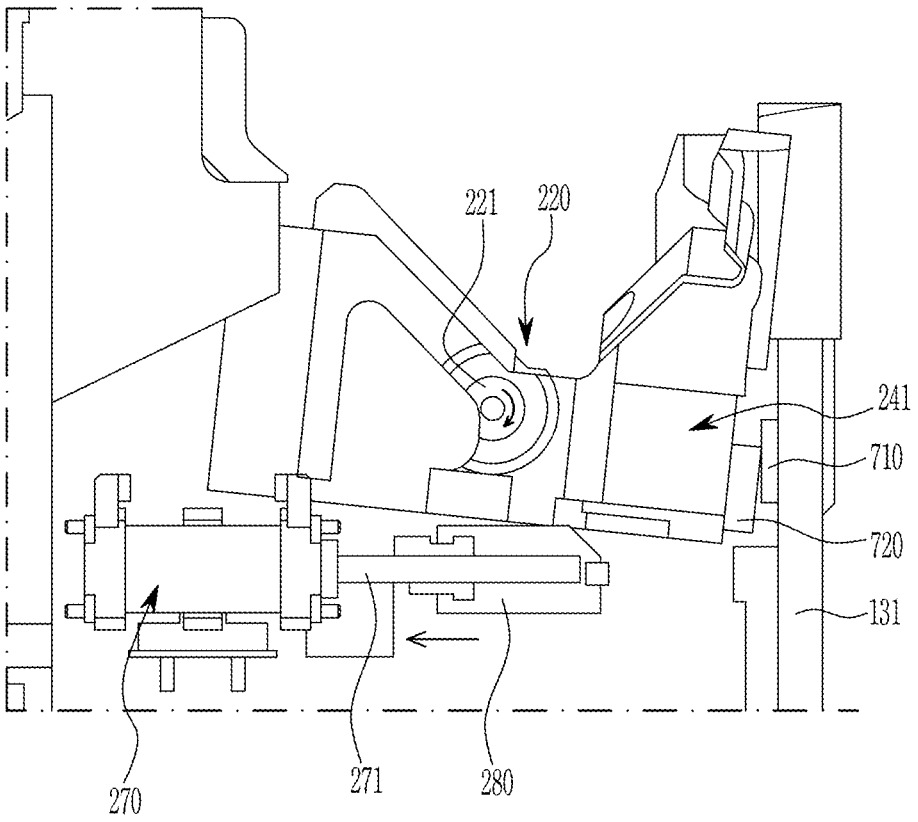
FIG. 18, FIG. 19, FIG. 20, FIG. 21 and FIG. 22 are drawings illustrating an operation of an apparatus for manufacturing a panel for a vehicle according to an exemplary embodiment of the present disclosure.

Furthermore, referring to FIG. 18, in an exemplary embodiment of the present disclosure, the operation rod 271 is moved backward by operation of the operation cylinder 270, and the cam support block 280 is in a state of being moved backward thereof.

Therefore, the swing cam 220 of the at least one cam press unit 210 is in a state of being swing-rotated to be inclined in one direction (e.g., forward or backward) through the rotation center shaft 221 in the lower die 130.

Figure 19:
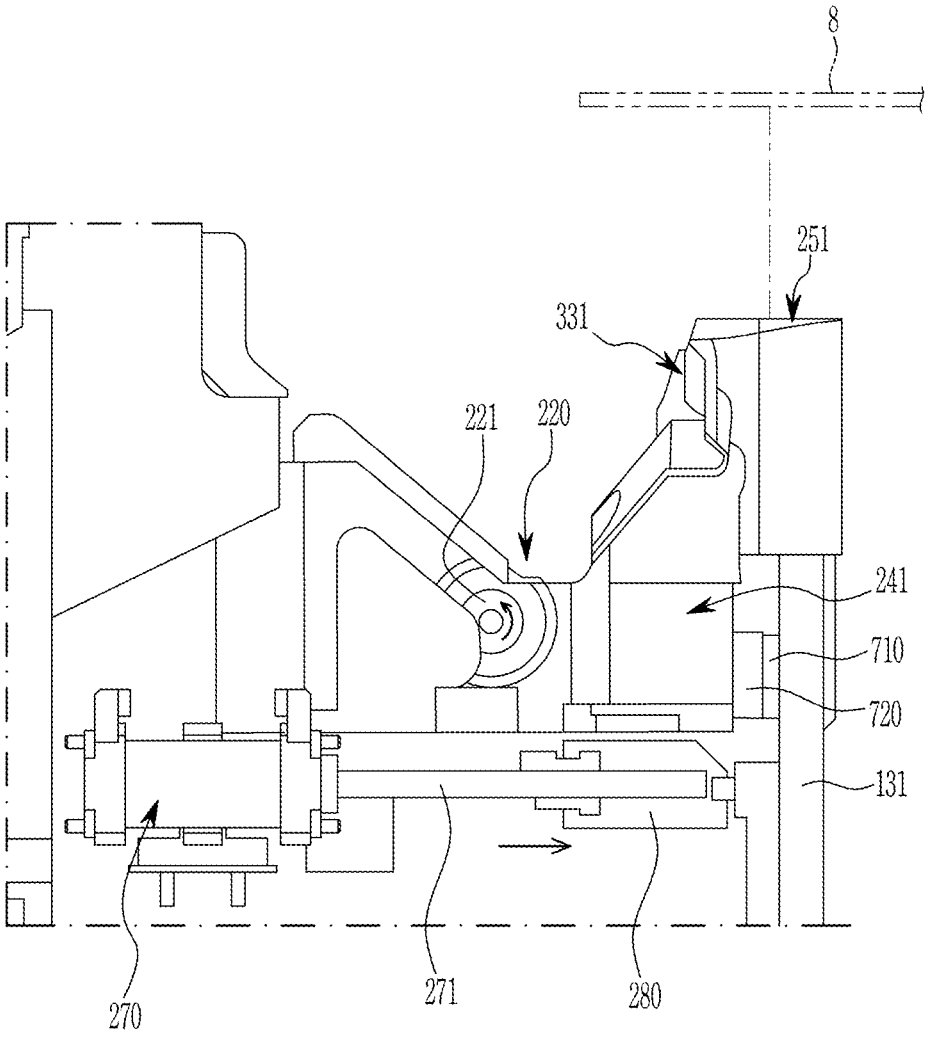
Figure 20:
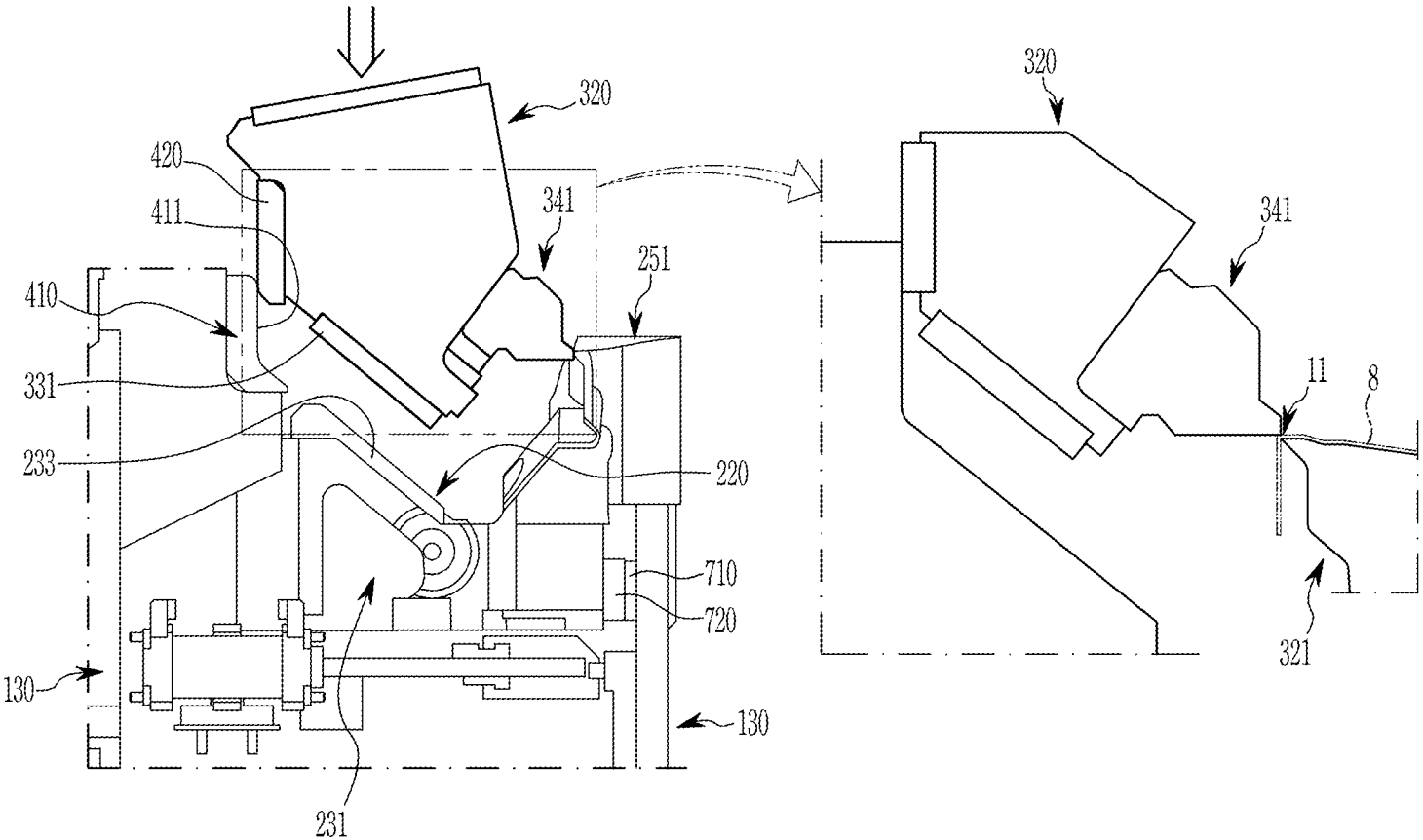
Figure 21:
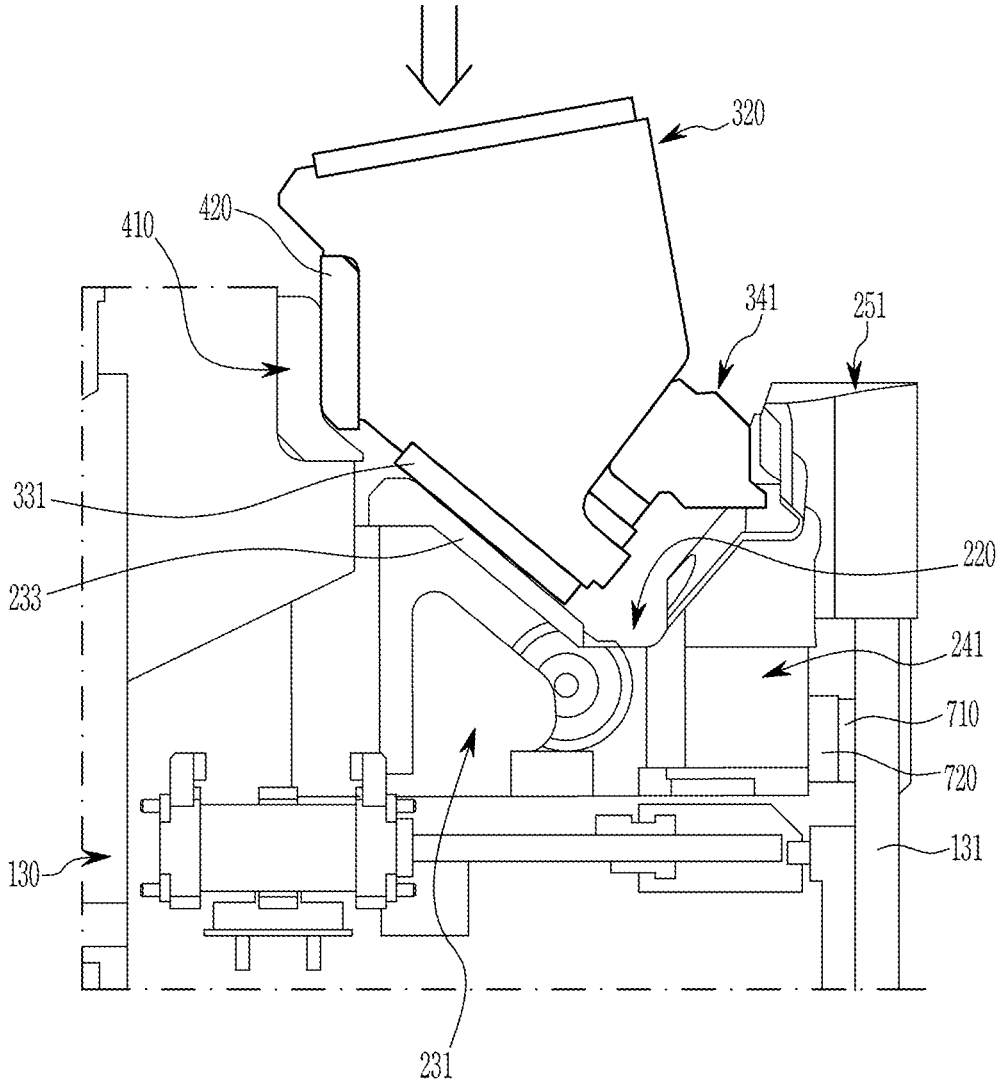

In the present state, as shown in FIG. 19, when the operation rod 271 moves forward by operation of the operation cylinder 270, the cam support block 280 moves forward thereof.

Accordingly, the swing cam 220 is rotated in another direction (e.g., backward or forward) through the rotation center shaft 221, and maintain the reference position which is horizontal along the front and rear direction thereof.

Here, the swing cam 220 may be swing-rotated along the swing guide surface 141 of the at least one lower forming steel 133 through the slip surface 257 of through the lower cam forming steel 251.

Furthermore, the at least one pressurizing block 720 fixed to the second cam block 241 of the swing cam 220 pressurizes the at least one pressurizing support block 710 the lower base 131 by a preset pressurizing force.

In the state of the swing cam 220 being rotated to the reference position, the second processing plate 8 is loaded above the at least one lower forming steel 133 and the lower cam forming steel 251. At the instant time, the at least one lower forming steel 133 and the lower cam forming steel 251 supports a portion connected to the first edge portion of the second processing plate 8.

Subsequently, referring to FIG. 16, at the position corresponding to the lower die 130, the upper die 150 moves downward together with the cam slide 320 of the at least one cam press unit 210.

As the upper die 150 moves downward, the at least one cam drive block 610 fixed to the upper die 150 is coupled to between the pair of drive guide blocks 620 fixed to the lower die 130.

During the present process, the at least one gas spring 510 provided in the upper die 150 pressurizes the at least one spring support block 520 provided in the first cam block 231 of the swing cam 220 by a preset pressurizing force.

Here, the cam slide 320 moves downward along the first guide surface 411 of the cam guide block 410 fixed to the lower die 130. At the instant time, the cam stroke plate 420 of the cam slide 320 is in slidable contact with the first guide surface 411, and is guided downward along the first guide surface 411.

Accordingly, the upper cam forming steel 341 mounted in the cam slide 320 forms the flange portion 11 in the first edge portion of the second processing plate 8 along the vertical direction through the lower cam forming steel 251 of the swing cam 220.

At the present time, the flange forming portion 343 of the upper cam forming steel 341 is butted against the flange forming support portion 253 of the lower cam forming steel 251 along the vertical direction, and may form the flange portion 11.

While forming the flange portion 11, the cam slide 320 is guided downward along the first guide surface 411 of the cam guide block 410 by the descending of the upper die 150, and becomes in cam-contact with the swing cam 220.

Here, the cam slide 320 becomes in cam-contact with the at least one first cam guide portion 233 of the swing cam 220 through the at least one second cam guide portion 331.

Figure 22:
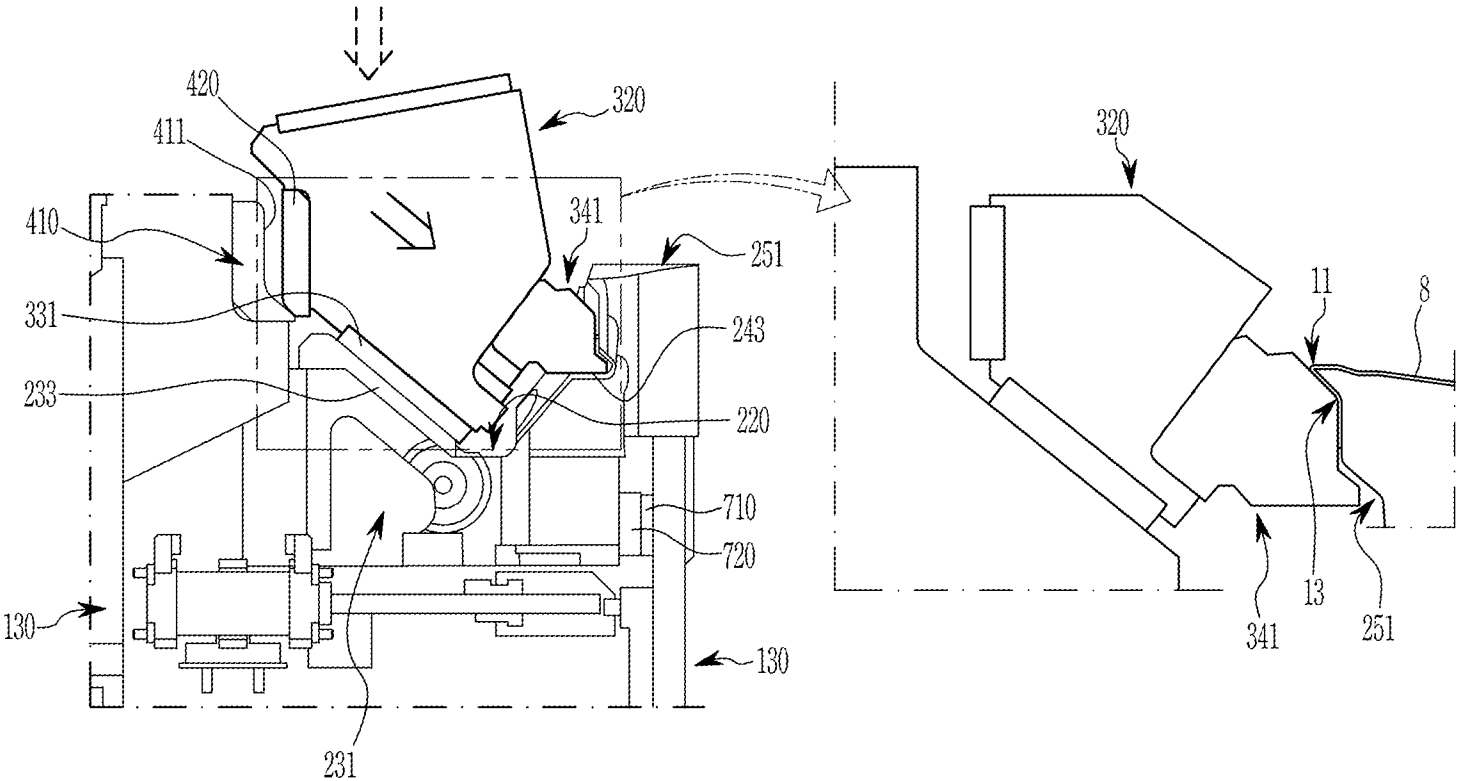

In such a state, the upper die 150 continues to descend further. Accordingly, as shown in FIG. 22, the cam slide 320 is guided along the second guide surface 413 of the cam guide block 410 through the cam stroke plate 420, and slides downward along the oblique direction thereof. At the instant time, the cam slide 320 moves along the oblique direction while sliding along the at least one first cam guide portion 233 of the swing cam 220 through the at least one second cam guide portion 331.

Furthermore, the upper cam forming steel 341 of the cam slide 320 moves along the oblique direction while being supported by the steel supporting portion 243 of the swing cam 220. That is, the upper cam forming steel 341 moves to a position corresponding to the lower cam forming steel 251 of the swing cam 220 along the oblique direction thereof.

Accordingly, the upper cam forming steel 341 forms the cam forming portion 13 extending from the flange portion 11 to the internal side of the second processing plate 8 through the lower cam forming steel 251 of the swing cam 220.

Here, the undercut forming portion 345 of the upper cam forming steel 341 is butted against the undercut forming support portion 255 of the lower cam forming steel 251 along the oblique direction, and may form the cam forming portion 13.

Meanwhile, before the cam-contacting of the swing cam 220 and the cam slide 320, the at least one gas spring 510 applies a preset pressurizing force to the first cam block 231 of the swing cam 220 through the at least one spring support block 520. Furthermore, the at least one pressurizing block 720 provided in the swing cam 220 applies a preset pressurizing force to the at least one pressurizing support block 710 fixed to the lower die 130.

Therefore, during the process of forming the flange portion 11 and the cam forming portion 13 in the first edge portion of the second processing plate 8, returning rotation or movement of the swing cam 220 by the cam slide 320 may be prevented.

Furthermore, when the lower die 130 and the upper die 150 are combined with each other, the at least one cam drive block 610 fixed to the upper die 150 is coupled to between the pair of drive guide blocks 620 fixed to the lower die 130.

Accordingly, the at least one cam drive block 610 and the pair of drive guide blocks 620 may prevent the slipping of the upper die 150 in the front and rear direction thereof.

Furthermore, the at least one cam drive block 610 and the pair of drive guide blocks 620 may guide the cam slide 320 in downward direction by the predetermined guiding amount before forming of the flange portion 11 by the swing cam 220 and the cam slide 320 (e.g., before the cam-contacting).

On the other hand, during the process of forming the flange portion 11 and the cam forming portion 13 to the first edge portion of the second processing plate 8, the at least one upper forming steel 153 of the upper die 150 and the at least one lower forming steel 133 of the lower die 130 form the second processing plate 8 into the final predetermined shape.

At the present time, the wheel arch forming portion 157 of the at least one upper forming steel 153 forms the wheel arch portion 15 in the second edge portion of the second processing plate 8 through the wheel arch forming support portion 137 of the at least one lower forming steel 133.

Here, the at least one upper forming steel 153 and the at least one cam press unit 210 may simultaneously perform forming of the flange portion 11, the cam forming portion 13, and the wheel arch portion 15 through the at least one lower forming steel 133.

Due to the simultaneous forming work of the at least one upper forming steel 153 and the at least one cam press unit 210, a uniform flange radius in the flange forming region may be secured, and thereby the quality of the final forming product may be secured.

Therefore, according to the apparatus 100 for manufacturing a panel for a vehicle according to an exemplary embodiment of the present disclosure, the fender panel 10 formed with the flange portion 11, the cam forming portion 13, and the wheel arch portion 15 as shown in FIG. 2 and FIG. 3 may be manufactured by the above-described processes.

On the other hand, in a state where the manufacture of the fender panel 10 is completed, the upper die 150 moves upward (e.g., released) from the lower die 130. Accordingly, the cam slide 320 may return to its original position by the elastic force of a return spring (e.g., a gas spring).

In such a state, when the operation rod 271 moves backward by operation of the operation cylinder 270, the cam support block 280 moves backward thereof. Accordingly, the swing cam 220 is swing-rotated to be inclined in one direction (e.g., forward or backward) through the rotation center shaft 221 (refer to FIG. 18).

Here, the swing cam 220 may be swing-rotated with the lower cam forming steel 251 along the swing guide surface 141 of the at least one lower forming steel 133 through the slip surface 257 of the lower cam forming steel 251.

Therefore, the fender panel 10 may be smoothly extracted (e.g., ejected) upwards from the at least one lower forming steel 133 without making an interference with the lower cam forming steel 251 of the swing cam 220 by the cam forming portion 13.

According to the apparatus 100 for manufacturing a panel for a vehicle according to an exemplary embodiment of the present disclosure, the final product of the fender panel 10 may be manufactured by a single mold for the second processing plate 8 pre-processed by the first mold 3 and the second mold 5.

According to the apparatus 100 for manufacturing a panel for a vehicle according to an exemplary embodiment of the present disclosure, the flange portion 11 may be formed by the first motion M1 in the vertical direction of the at least one cam press unit 210. Furthermore, according to the apparatus 100 for manufacturing a panel for a vehicle according to an exemplary embodiment of the present disclosure, the cam forming portion 13 extending from the flange portion 11 to the internal side of the second processing plate 8 may be formed by the second motion M2 in the oblique direction of the at least one cam press unit 210.

Therefore, according to the apparatus 100 for manufacturing a panel for a vehicle according to an exemplary embodiment of the present disclosure, the numbers of molds and processes required for manufacturing the fender panel 10 may be decreased. Accordingly, mold investment cost, mold material cost, processing cost, cost required for production management, and the like may be reduced, improving an actual cost competitiveness.

Furthermore, according to the apparatus 100 for manufacturing a panel for a vehicle according to an exemplary embodiment of the present disclosure, the uniform quality of the fender panel 10 may be secured because the slipping of the upper die 150 may be prevented and the returning rotation and movement of the swing cam 220 may also be prevented during the forming of the fender panel 10.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present disclosure have been presented for purposes of illustration and description. They are not intended to be exhaustive or to limit the present disclosure to the precise forms disclosed, and obviously many modifications and variations are possible in light of the above teachings. The exemplary embodiments were chosen and described to explain certain principles of the present disclosure and their practical application, to enable others skilled in the art to make and utilize various exemplary embodiments of the present disclosure, as well as various alternatives and modifications thereof. It is intended that the scope of the present disclosure be defined by the Claims appended hereto and their equivalents.

What is claimed is:

1. An apparatus for manufacturing a panel for a vehicle to process a pre-processed processing plate into the panel of a predetermined shape, the apparatus comprising:

a lower die including a lower base mounted with at least one lower forming steel;

an upper die provided vertically movable at a position corresponding to the lower die, and including an upper base mounted with at least one upper forming steel; and at least one cam press unit provided on the lower die and the upper die, and configured to form a flange portion in an edge portion of the processing plate along a vertical direction, and to form a cam forming portion extending from the flange portion along an oblique direction thereof, wherein the at least one cam press unit includes:

a swing cam rotatably provided on the lower base along a front and rear direction through a rotation center shaft and including a lower cam forming steel; and a cam slide slidably provided on the upper base along the front and rear direction to be in cam-contact with the swing cam and mounted with an upper cam forming steel corresponding to the lower cam forming steel, and wherein the lower die includes a cam guide block which is fixed to the lower base, the cam guide block including:

a first guide surface configured to guide the cam slide in the vertical direction; and a second guide surface extending from the first guide surface to guide the cam slide in the oblique direction.

2. The apparatus of claim 1, wherein the at least one cam press unit is configured to:

form the flange portion by a first motion in the vertical direction; and form the cam forming portion by a second motion in the oblique direction, the cam forming portion including an undercut surface extending from the flange portion to an internal side of the processing plate.

3. The apparatus of claim 1, wherein the at least one lower forming steel includes a swing guide surface formed in a first edge portion and extending inwardly from the first edge portion, and wherein the lower cam forming steel includes a slip surface configured to contact with the swing guide surface.

4. The apparatus of claim 1, wherein the rotation center shaft is coupled to an eccentric point biased from a center portion of the swing cam.

5. The apparatus of claim 1, wherein the at least one cam press unit includes:

an operation cylinder provided on the lower base and including an operation rod configured for operating forwards and backwards along the front and rear direction thereof; and a cam support block provided movable on the lower base along the front and rear direction to support a lower portion of the swing cam, and coupled to the operation rod.

6. The apparatus of claim 1, wherein the swing cam includes:

a first cam block including at least one first cam guide portion which is disposed inclined along the front and rear direction and in cam-contact with the cam slide; and a second cam block including the lower cam forming steel and extending from the first cam block.

7. The apparatus of claim 6, wherein the second cam block includes:

a steel supporting portion connected to the lower cam forming steel and configured to support the upper cam forming steel.

8. The apparatus of claim 6, wherein the cam slide includes a sliding cam body mounted with the upper cam forming steel and including at least one second cam guide portion which is in cam-contact with the at least one first cam guide portion and disposed inclined along the front and rear direction.

9. The apparatus of claim 1, wherein the lower cam forming steel includes:

a flange forming support portion formed in an edge portion of the lower cam forming steel along the vertical direction, and configured to form the flange portion; and an undercut forming support portion extending inwardly from the flange forming support portion, and configured to form the cam forming portion.

10. The apparatus of claim 9, wherein the upper cam forming steel includes:

a flange forming portion butted against the flange forming support portion in the vertical direction and configured to form the flange portion; and an undercut forming portion extending from the flange forming portion, butted against the undercut forming support portion in the oblique direction, and configured to form the cam forming portion.

11. The apparatus of claim 1, wherein the upper die includes at least one gas spring provided on the upper base along the vertical direction and configured to pressurize the swing cam.

12. The apparatus of claim 11, wherein at least one spring support block for supporting the at least one gas spring is fixed to the swing cam.

13. The apparatus of claim 1, wherein the at least one upper forming steel and the at least one cam press unit are configured to simultaneously perform forming of the processing plate, at a position corresponding to the at least one lower forming steel.

14. An apparatus for manufacturing a panel for a vehicle to process a pre-processed processing plate pre-processed by at least one mold into the panel of a predetermined shape by at least one another mold, the apparatus comprising:

a lower die including a lower base mounted with at least one lower forming steel;

an upper die provided vertically movable at a position corresponding to the lower die, and including an upper base mounted with at least one upper forming steel; and at least one cam press unit provided on the lower die and the upper die, and configured to form a flange portion in an edge portion of the processing plate along a vertical direction, and to form a cam forming portion extending from the flange portion along an oblique direction thereof, wherein the upper die includes at least one cam drive block fixed to the upper base, wherein the lower die includes a pair of drive guide blocks disposed on the lower base at a preset interval so that the at least one cam drive block is insertable along the vertical direction.

15. An apparatus for manufacturing a panel for a vehicle to process a pre-processed processing plate into the panel of a predetermined shape, the apparatus comprising:

a lower die including a lower base mounted with at least one lower forming steel;

an upper die provided vertically movable at a position corresponding to the lower die, and including an upper base mounted with at least one upper forming steel; and at least one cam press unit provided on the lower die and the upper die, and configured to form a flange portion in an edge portion of the processing plate along a vertical direction, and to form a cam forming portion extending from the flange portion along an oblique direction thereof, wherein the at least one cam press unit includes:

a swing cam rotatably provided on the lower base along a front and rear direction through a rotation center shaft and including a lower cam forming steel; and a cam slide slidably provided on the upper base along the front and rear direction to be in cam-contact with the swing cam and mounted with an upper cam forming steel corresponding to the lower cam forming steel, wherein at least one pressurizing support block is provided on the lower base, and wherein at least one pressurizing block for pressurizing the at least one pressurizing support block is provided on the swing cam.

* * * * *